US007878171B2

(12) United States Patent
Vandike et al.

(10) Patent No.: US 7,878,171 B2
(45) Date of Patent: Feb. 1, 2011

(54) ENGINE COOLING FLOW DEBRIS CLEANER AND AIR PRE-CLEANER ASPIRATOR

(75) Inventors: Nathan R. Vandike, Genseo, IL (US); Alan D. Sheidler, Moline, IL (US)

(73) Assignee: Deere & Company, Moline, IL (US)

( * ) Notice: Subject to any disclaimer, the term of this patent is extended or adjusted under 35 U.S.C. 154(b) by 337 days.

(21) Appl. No.: 12/140,397

(22) Filed: Jun. 17, 2008

(65) Prior Publication Data

US 2009/0308346 A1 Dec. 17, 2009

(51) Int. Cl.
*F01P 11/12* (2006.01)
*F01P 5/02* (2006.01)
*F28F 19/01* (2006.01)

(52) U.S. Cl. ..... 123/198 E; 123/41.49; 165/119; 165/95; 55/392; 180/68.1; 180/68.2

(58) Field of Classification Search ..... 123/41.49, 123/198 E; 165/95, 119; 55/392, 394, 307; 180/68.1, 68.2, 68.4, 68.6
See application file for complete search history.

(56) References Cited

U.S. PATENT DOCUMENTS 1,745,950 A * 2/1930 Orem ..... 55/334
2,708,920 A * 5/1955 Pasturczak ..... 123/198 E
6,004,382 A * 12/1999 Pikesh et al. ..... 95/270
6,780,215 B2 * 8/2004 Keen et al. ..... 55/385.3

FOREIGN PATENT DOCUMENTS

EP 313763 A1 * 5/1989
GB 2433220 A * 12/2005

* cited by examiner

*Primary Examiner*—Michael Cuff
*Assistant Examiner*—Hung Q Nguyen
(74) *Attorney, Agent, or Firm*—Taylor IP, P.C.

(57) ABSTRACT

A work vehicle operating in a highly contaminated environment has a radiator with a rotary screen debris removal device upstream of the radiator. The debris thus removed passes through a fan for disposal away from the work machine. The engine is an air breathing fuel consuming engine and has a pre-cleaner for removing larger particles of air delivered to the engine for combustion. A conduit extends from the intake air pre-cleaner to a venturi device adjacent to and upstream of the fan for continuously and effectively removing particles from the engine air pre-cleaner.

18 Claims, 2 Drawing Sheets

ENGINE COOLING FLOW DEBRIS CLEANER AND AIR PRE-CLEANER ASPIRATOR

FIELD OF THE INVENTION

The invention relates to a work machine and more specifically a work machine operating under highly contaminated conditions and to the removal of excess debris and particles from the air used to cool the work machine prime mover engine and to supply combustion air.

BACKGROUND OF THE INVENTION

The class of work machines utilized for agricultural, industrial and other uses termed as work machines typically operates in a highly contaminated environment, thus making the function of cleaning air used by an air breathing internal combustion engine especially important. Nowhere is this as important as in the agricultural field where the work machine is in a field harvesting crops which generates significant contaminants in the form of debris and particles. It is necessary for such machines to have a pre-cleaner since the ambient level of particles is so significant. An air filter alone would quickly become clogged. In the present environment, pre-cleaners are employed upstream of the primary filter for the air intake system of the engine. Such pre-cleaners may take various forms but, as used commercially, usually are systems imparting a centrifugal motion to the air leading to the primary air filter inlet. Such centrifugal motion causes the denser particles to be thrown to the outer periphery of the pre-cleaner, leaving the less contaminated air to exit to the primary filter through a central inlet. Such air pre-cleaners have an outlet for the accumulated particles and some units have that outlet connected to an aspirator positioned in a muffler in the engine exhaust system. Problems can occur with an arrangement of this type since the connection to the exhaust system has the potential of increasing back pressure and thereby decreasing the efficiency of the engine. In addition, the performance of the flow through the engine exhaust system depends significantly on engine load thereby generating a variable removal of particles from the pre-cleaner.

Other approaches seek to remove excess particles from a pre-cleaner by utilizing the pressure drop created by the engine cooling fan since this fan is solely dependent on engine rpm and not engine load. However this too has limitations on its effectiveness.

What is needed in the art therefore is a system in which excess particles from an engine pre-cleaner are removed consistently and with a minimum of parasitic losses.

SUMMARY OF THE INVENTION

In one form, the invention includes a working vehicle having a vehicle body and an air breathing, fuel consuming, internal combustion engine carried by the vehicle body. An air intake system for the engine includes a primary air filter and a pre-cleaner for collecting larger particles, the pre-cleaner having a conduit to carry away the particles. A cooling system is connected to the engine and has a heat exchanger through which air flows to remove heat from the engine. A device for removing debris from the air flowing through and upstream of the heat exchanger has a conduit for carrying away debris. A device is provided for pulling air through the debris conduit and a venturi device is interposed in the debris conduit and has a throat connecting to the particle conduit for removing particles from the pre-cleaner.

In another form, the invention is an internal combustion engine system having an air breathing, fuel consuming, internal combustion engine and an air intake system for the engine including a primary air filter and a pre-cleaner for collecting larger particles, the pre-cleaner having a conduit to carry away the particles. A cooling system is connected to the engine and has a heat exchanger through which air flows to remove heat from the engine. A device is provided for removing debris from the air flowing through and upstream of the heat exchanger, the device having a conduit for carrying away debris. A device is provided for pulling air through the debris conduit and a venturi device is interposed in the debris conduit. The venturi device has a throat connecting to the particle conduit for removing particles from the pre-cleaner.

DETAILED DESCRIPTION OF THE INVENTION

Figure 1:
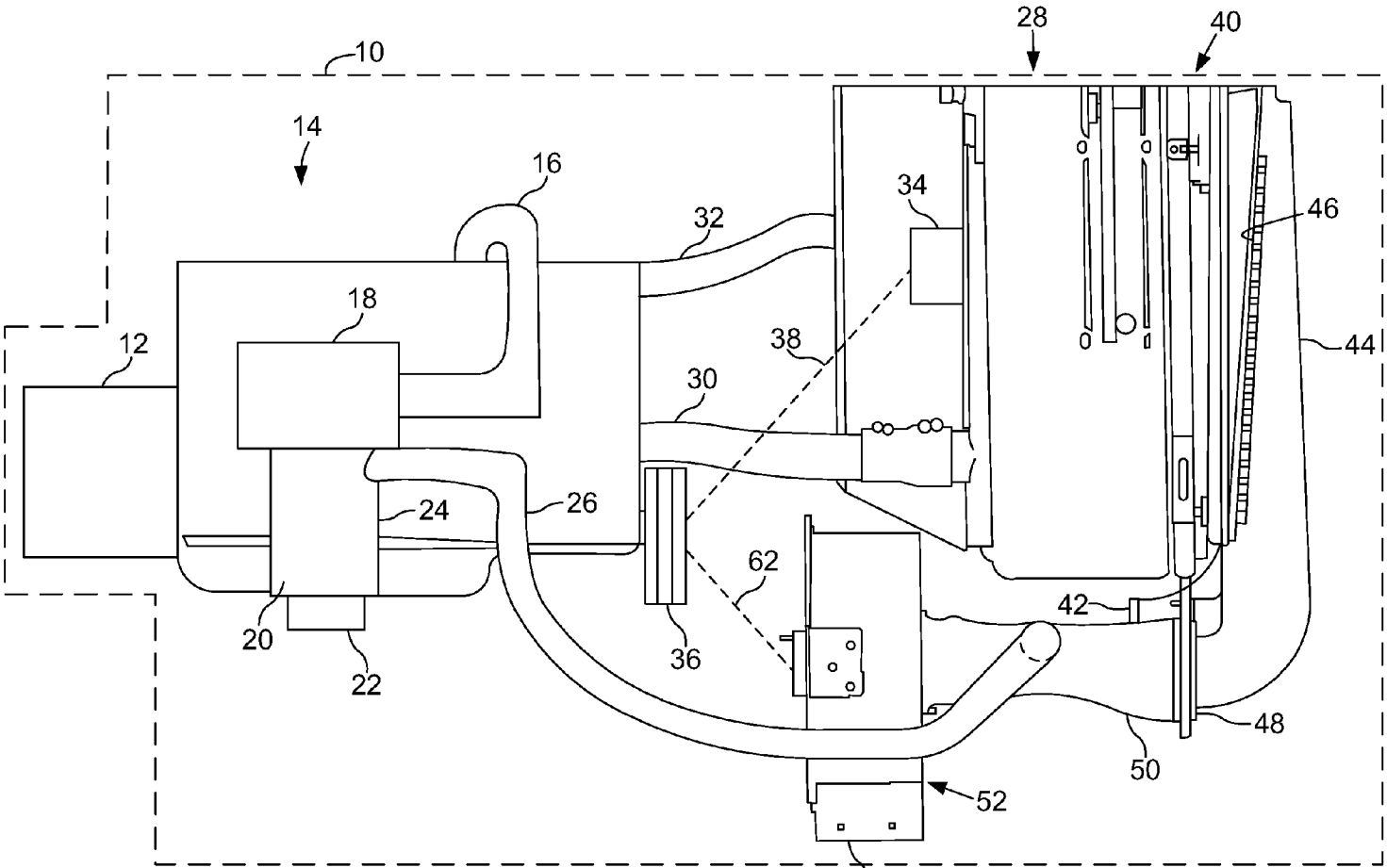
FIG. 1 is a side view of a work vehicle embodying the present invention.

Referring to FIG. 1, there is shown a portion of a work machine 10 in the form of an agricultural vehicle, particularly the rear end drive train of the vehicle. Although shown as an agricultural vehicle it is possible the work machine 10 could be in the form of a different type of work machine such as a construction or forestry vehicle.

Work machine 10 includes a transmission 12 providing motive power for the work machine as well as powering agricultural crop harvesting and processing components and various hydraulic accessory devices. Transmission 12 is powered by an air breathing fuel consuming internal combustion engine, generally shown at 14.

Internal combustion engine 14 may be one of a number of types of internal combustion engine including turbocharged or non-turbocharged but in any case the engine requires a source of combustion air delivered to an intake manifold of engine 14 by an inlet conduit 16. Inlet conduit 16 extends from a primary air filtration unit 18. Primary air filtration device is constructed to provide removal of fine particles from the air consumed by engine 14. Since the work machine 10 operates in an extremely debris laden environment in air pre-cleaner 20 is connected to an up stream of primary air filtration device 18.

Throughout this application, the term "particles" is used to denote unwanted material in the combustion air stream for engine 14. As mentioned later, the term "debris" is used to denote unwanted material in the engine cooling air stream. These terms are used for convenience to designate separate materials that need to be removed from use by the work machine engine 14. It should be apparent to those skilled in the art that other terms may be used to designate these materials.

Air pre-cleaner 20 has a lower facing air inlet 22 which receives the primary air for combustion by engine 14. Air pre-cleaner 20 may take any one of a number of forms but as practice commercially it is a form of centrifugal flow where inlet air is forced into a swirl pattern so that the heavier particles pass to the outside by virtue of centrifugal action and the finer particles including air pass through a central outlet (not shown) to primary air filtration device 18. In order to carry away the particles thus collected by pre-cleaner 20, an outlet 24 connects to a particle conduit 26.

Engine 14, as usually employed in work machines, is a liquid cooled engine in which a liquid coolant is circulated through internal passages in engine 14 and to a heat exchange device generally indicated by reference character 28. Heat exchange device 28, in usual form, is a radiator in which coolant is supplied from an engine via coolant conduit 30 to a lower portion of the radiator and returned to the engine by an upper coolant conduit 32. Details of the coolant flow passages, as well as the pumping means for circulating the coolant, are not shown to facilitate an understanding of the present invention.

The coolant device or radiator 28 is an air to liquid heat exchanger in which air flow is passed through device 28 by a fan only the hub 34 of which is shown. Fan hub 34 may be driven from an engine accessory pulley 36 by a mechanical connection 38. This connection may be continuous or interrupted as needed for coolant flow. Furthermore, the fan hub 34 may be driven by other devices such as hydraulic and electrical.

The engine cooling air flow is from the right to the left of FIG. 1 and a device generally indicated by reference character 40 is provided in the air flow and upstream of radiator 28. The device 40 eliminates debris from the air passing across the radiator 28 so as to prevent clogging of the passages and reduction in effectiveness. Device 40 may be a rotating screen 42 of appropriate porosity to collect anticipated sizes of debris material. Screen 42 is driven by an appropriate mechanism to constantly be rotating past radiator 28. The axis of the rotating screen 42 generally is near the center of the radiator. A debris collecting conduit 44 is positioned radially with respect to the rotary screen 42 and has an appropriate mechanism to provide agitation of debris on the surface. Conduit 44 has an elongated inlet 46 which extends to a lower outlet 48. A venturi device 50 connects to outlet 48 and to a device 52 for producing air flow through debris conduit 44 and out off a downward facing outlet 54.

Device 40 may be in other forms such as reciprocating ducts on rectangular or square screens. Still other forms are available to those skilled in the art. Whatever form of device 40 is used, it will have a conduit through which debris is carried away to the device 52.

Figure 2:
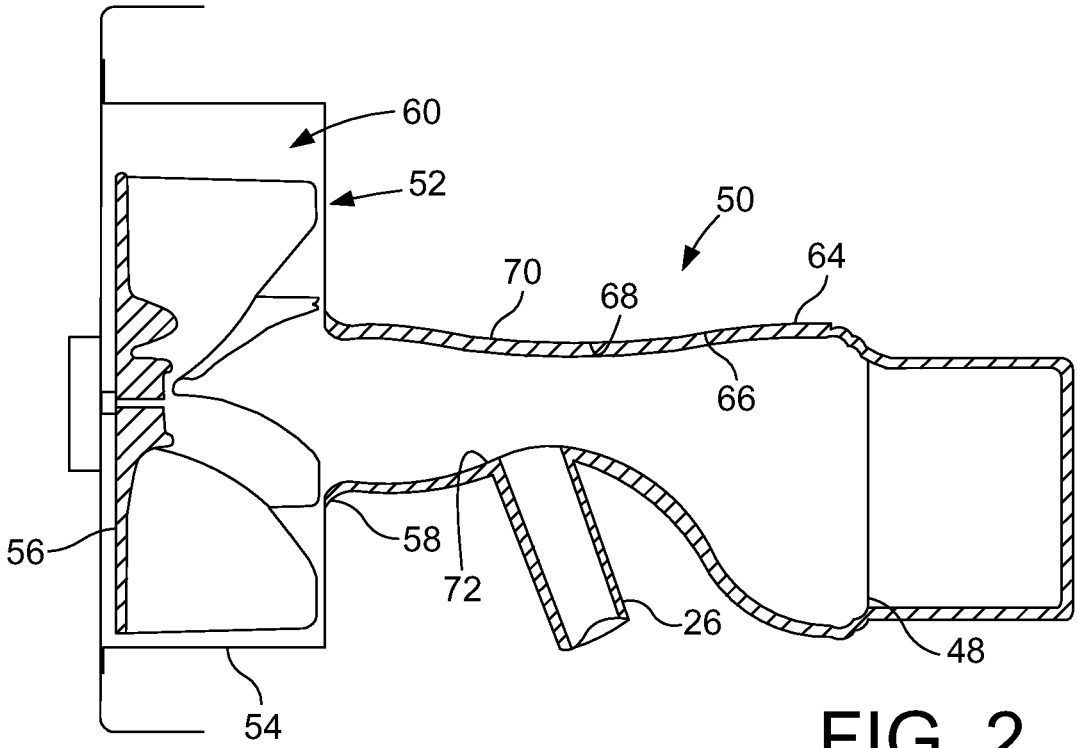
FIG. 2 is one form of a particle removal device used in FIG. 1.

As shown particularly in FIG. 2, the device 52 has a fan 56 which has a central inlet at 58 from the venturi device 50 and which discharges air centrifugally into a volute 60 which connects with the downward facing outlet 54. Fan 56 is driven from engine accessory pulley 36 by an appropriate mechanical connection identified by reference character 62.

The device 52 generates a consistent flow of air from radial inlet 46 through downward facing outlet 54. The primary air flow through radiator 28 keeps the debris on rotating screen 42, but at the point where the debris passes across inlet 46, the pressure across the screen is interrupted sufficiently so that debris on the screen 42 is removed through inlet 46 and passes to downward facing outlet 54. This operation is a continuous one since the vehicle can be operating in a highly debris laden environment at any time. Consequently there is continuous air flow passing from the inlet 46 to the outlet 54.

In accordance with the invention, the venturi device 50, shown in detail in FIG. 2, is provided between outlet 48 and device 52. Venturi device 50 comprises a duct 64 appropriately connected to outlet 48 and to the inlet 58 of device 52. As is apparent from FIG. 2, the venturi device 50 has a convergent section 66, a throat 68 and a divergent section 70. An opening 72 in the throat section 68 connects to particle conduit 26. The movement of air in the convergent section and through the throat 68 creates a pressure drop lower than that for the intake air pre-cleaner 20 so that particles discharged into the conduit 26 pass through outlet 72, through fan 56, and through the downward facing outlet 54 along with debris from the primary engine air flow cooling circuit. By providing a simple venturi connection in the debris removal air flow circuit, an effective and continuous way of removing particles form the air pre-cleaner is provided. This is done without significant parasitic losses because the engine cooling air is required to be cleaned at all times. The amount of air flow from the pre-cleaner 20 is but a small proportion of the cooling air flow so that a minimum disturbance and obstruction to the main debris removal circuit is provided.

Figure 3:
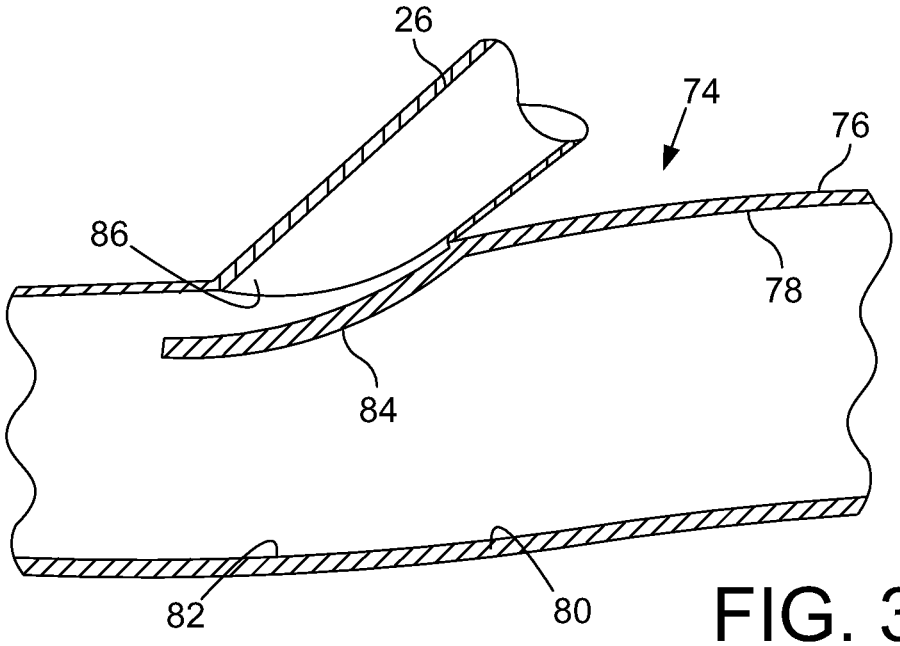
FIG. 3 is an alternate form of a device for removing particles from the work vehicle of FIG. 1.

An alternative form of venturi is shown in FIG. 3 in which a device 74 has a conduit 76 with a converging section 78. Although the cross-section shown in FIG. 3 appears to have no significant convergence, the passage is formed so that converging section is extending out of the plane of FIG. 3. The device 74 then has a throat 80 and an outlet section 82 leading to the device 52. A tab 84 extends from the upstream portion of a particle inlet 86 in a down stream direction to provide an appropriate reduction in pressure to cause particles to pass through particle conduit 26 to outlet section 82 which leads to the device 52 for ultimate disposal.

For both devices the needed function of disposing of the particles from the air inlet pre-cleaner is continuously and effectively accomplished with a minimum of parasitic losses. This is because the function of the cleaning of engine air cooling flow remains constant and is unaffected by power output and demands on engine 12. Since the device is a simple venturi and aspiration device there are no moving parts to add complication and a potential for unreliability to the system.

Having described the preferred embodiment, it will become apparent that various modifications can be made without departing from the scope of the invention as defined in the accompanying claims.

The invention claimed is:

1. A working vehicle comprising:

a vehicle body;

an air breathing fuel consuming internal combustion engine carried by said vehicle body;

an air intake system for said engine including a primary air filter and a pre-cleaner for collecting larger particles, said pre-cleaner having a conduit to carry away said particles;

a cooling system connected to said engine, said cooling system having a heat exchanger through which air flows to remove heat from said engine;

a device for removing debris from the air flowing through and upstream of said heat exchanger, said debris removal device having a conduit for carrying away debris;

a device for pulling air through said debris conduit; and a venturi device interposed in said debris conduit and having a throat connecting to said particle conduit for removing particles from said pre-cleaner.

2. The working vehicle as claimed in claim 1, wherein said air pre-cleaner is a centrifugal pre-cleaner.

3. The working vehicle as claimed in claim 1, wherein the heat exchanger is a radiator through which ambient air flows to remove heat from said engine.

4. The working vehicle as claimed in claim 3, wherein said debris removing device is a rotary screen fluidly connected to an up stream of the radiator and a conduit on a radial segment of said screen to remove debris.

5. The working vehicle as claimed in claim 1, wherein the device for pulling air through the debris conduit is a fan.

6. The working vehicle as claimed in claim 1, wherein said venturi device is adjacent and upstream of the device for pulling air.

7. The working vehicle as claimed in claim 6, wherein said venturi device comprises a convergent section and a throat, said venturi device having an inlet for connecting to the particle conduit to pull particles through to the throat.

8. The working machine as claimed in claim 6, wherein said venturi device comprises a convergent section connected to a throat and a baffle upstream of an opening to said particle conduit to carry particles to said throat.

9. The working machine as claimed in claim 5, wherein said fan is driven by said engine.

10. An internal combustion engine system comprising:

an air breathing fuel consuming internal combustion engine;

an air intake system for said engine including a primary air filter and a pre-cleaner for collecting larger particles, said pre-cleaner having a conduit to carry away said particles;

a cooling system connected to said engine, said cooling system having a heat exchanger through which air flows to remove heat from said engine;

a device for removing debris from the air flowing through and upstream of said heat exchanger, said device having a conduit for carrying away debris;

a device for pulling air through said air debris conduit; and a venturi device interposed in said debris conduit and having a throat connecting to said particle conduit for removing particles from said pre-cleaner.

11. The internal combustion engine system as claimed in claim 10, wherein said pre-cleaner is a centrifugal pre-cleaner centrifuging larger particles to a radially outer section for entry to said particle conduit.

12. The internal combustion engine system as claimed in claim 10, wherein said heat exchanger is a radiator through which air flows to remove heat from said engine.

13. The internal combustion engine system as claimed in claim 12, wherein said debris removal device is a rotary screen positioned upstream of said radiator and having a radially extending conduit for removal of debris from said screen.

14. The internal combustion engine system as claimed in claim 10, wherein the device to pull air is a fan.

15. The internal combustion engine system as claimed in claim 10, wherein said venturi is adjacent and upstream of said air pulling device.

16. The internal combustion engine system as claimed in claim 15, wherein said venturi device comprises a convergent section and a throat and an outlet extending into said throat from said particle conduit.

17. The internal combustion engine as claimed in claim 15, wherein said venturi device has a convergent section, a throat and a baffle at said throat upstream of said opening to connect with said particle conduit.

18. The internal combustion engine as claimed in claim 14, wherein said fan is driven by said engine.

* * * * *